US010022980B2

(12) United States Patent
Tanaka et al.

(10) Patent No.: US 10,022,980 B2
(45) Date of Patent: Jul. 17, 2018

(54) RECORDING HEAD AND INKJET RECORDING APPARATUS

(71) Applicant: CANON KABUSHIKI KAISHA, Tokyo (JP)

(72) Inventors: Hirokazu Tanaka, Inagi (JP); Fumiko Suzuki, Kawasaki (JP); Tsukasa Doi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/661,947

(22) Filed: Jul. 27, 2017

(65) Prior Publication Data

US 2018/0029377 A1 Feb. 1, 2018

(30) Foreign Application Priority Data

Jul. 29, 2016 (JP) ..... 2016-150412

(51) Int. Cl.
*B41J 2/145* (2006.01)
*B41J 2/21* (2006.01)

(52) U.S. Cl.
CPC ..... *B41J 2/2103* (2013.01); *B41J 2/145* (2013.01)

(58) Field of Classification Search
CPC ... B41J 2/135; B41J 2/14; B41J 2/1433; B41J 2/2103; B41J 2/2121; B41J 2/2125; B41J 2/512; B41J 2/145; B41J 2/15; B41J 2/155; B41J 2002/14475
See application file for complete search history.

(56) References Cited

U.S. PATENT DOCUMENTS

2008/0012898 A1* 1/2008 Tsuchii ..... B41J 2/145 347/40
2008/0036818 A1* 2/2008 Yamanaka ..... B41J 2/1433 347/40
2008/0143786 A1 6/2008 Oikawa
2008/0259115 A1* 10/2008 Yamaguchi ..... B41J 2/16532 347/30
2010/0045719 A1* 2/2010 Akama ..... B41J 2/2103 347/12
2017/0036465 A1* 2/2017 Suzuki ..... B41J 25/001
2017/0334202 A1* 11/2017 Seki ..... B41J 2/21

FOREIGN PATENT DOCUMENTS

JP 2010-046904 A 3/2010
JP 2010-076394 A 4/2010

* cited by examiner

*Primary Examiner* — Geoffrey Mruk
*Assistant Examiner* — Scott A Richmond
(74) *Attorney, Agent, or Firm* — Canon U.S.A., Inc. IP Division

(57) ABSTRACT

A discharge port array unit including discharge ports having a small discharge port diameter is not arranged in a position adjacent to a discharge port array unit generating a strong airflow, and a discharge port array unit including discharge port array having not a small discharge port diameter is arranged in the position adjacent to the discharge port array unit generating a strong airflow.

18 Claims, 12 Drawing Sheets

RECORDING HEAD AND INKJET RECORDING APPARATUS

BACKGROUND OF THE INVENTION

Field of the Invention

The present disclosure relates to a recording head and an inkjet recording apparatus.

Description of the Related Art

An inkjet recording apparatus which forms an image on a recording medium by scanning the recording medium with a recording head while discharging ink has been known. The recording head includes discharge port arrays in which a plurality of discharge ports for discharging ink is arranged.

Such an inkjet recording apparatus is known as an apparatus that sometimes generates a strong airflow associated with the discharge of ink near a discharge port array if the amount of ink discharged from the discharge port array is large. Ink droplets discharged from another discharge port array arranged in a position adjacent to the discharge port array may be thus affected by the airflow, and landing positions of the ink droplets may deviate from desired positions.

Japanese Patent Application Laid-Open No. 2010-046904 discusses a configuration in which discharge port arrays for discharging inks of basic colors (three primary colors) are not arranged near a discharge port array that generates a strong airflow, and discharge port arrays for discharging ink of a color that can be replaced with the inks of the basic colors are arranged near the discharge port array that generates a strong airflow. Specifically, Japanese Patent Application Laid-Open No. 2010-046904 discusses a recording head in a system in which a discharge port array of yellow ink generates a strong airflow. In the recording head, discharge port arrays of the inks of the other basic colors, namely, cyan ink and magenta ink are not arranged in positions next to the discharge port array of yellow ink, but discharge port arrays of gray ink and black ink are arranged in positions adjacent to the discharge port array of yellow ink. According to Japanese Patent Application Laid-Open No. 2010-046904, the recording head can be reduced in size while the occurrence of landing position deviations of the inks of the basic colors which have a high impact on image quality is suppressed.

Ink droplets discharged from discharge port arrays having smaller discharge port diameters, i.e., ink droplets having smaller sizes are more strongly affected by the foregoing airflow. If such discharge port arrays are arranged near the discharge port array that generates the strong airflow, image quality drops considerably.

According to Japanese Patent Application Laid-Open No. 2010-046904, the discharge port arrays to be arranged near the discharge port array of which the amount of ink discharged is large are determined based only on whether the ink color is basic color (whether the color has a high impact on image quality). For example, as illustrated in FIG. 11 of Japanese Patent Application Laid-Open No. 2010-046904, in a system in which non-basic color gray ink is discharged from discharge port arrays having a small discharge port diameter, the discharge port arrays of gray ink are then arranged near the discharge port array of yellow ink which generates a strong airflow. Gray ink droplets discharged have a small size. If such a recording head is used, the discharged gray ink droplets are strongly affected by the airflow and may deviate from the landing position. This can cause a certain degree of drop in image quality although gray ink has not as high an impact on image quality as the inks of the basic colors do.

SUMMARY OF THE INVENTION

The present disclosure is directed to providing a recording head in which ink droplets discharged from a discharge port array having a small discharge port diameter are less susceptible to an airflow associated with discharge of ink from another discharge port array.

According to an aspect of the present disclosure, a recording head comprising a plurality of discharge port array units each including at least one of a first discharge port array in which discharge ports having a first diameter as a discharge port diameter are arranged in a predetermined direction, a second discharge port array in which discharge ports having a second diameter smaller than the first diameter as a discharge port diameter are arranged in the predetermined direction, and a third discharge port array in which discharge ports having a third diameter smaller than the second diameter as a discharge port diameter are arranged in the predetermined direction, the plurality of discharge port array units including a first discharge port array unit configured to discharge ink of a first color, a second discharge port array unit configured to discharge ink of a second color, and a third discharge port array unit configured to discharge ink of a third color, the plurality of discharge port array units being juxtaposed in a crossing direction crossing the predetermined direction, wherein the first discharge port array unit includes N first discharge port arrays and does not include the second or third discharge port array, where N is equal to 2 or more, wherein the second discharge port array unit does not include N or more first discharge port arrays, includes the second discharge port array, and does not include the third discharge port array, wherein the third discharge port array unit includes the third discharge port array, and wherein the third discharge port array unit is not adjacent to the first discharge port array unit in the crossing direction, and the second discharge port array unit is adjacent to the first discharge port array unit in the crossing direction.

Further features of the present disclosure will become apparent from the following description of exemplary embodiments with reference to the attached drawings.

DESCRIPTION OF THE EMBODIMENTS

A first exemplary embodiment of the present disclosure will be described in detail below with reference to the drawings.

Figure 1:
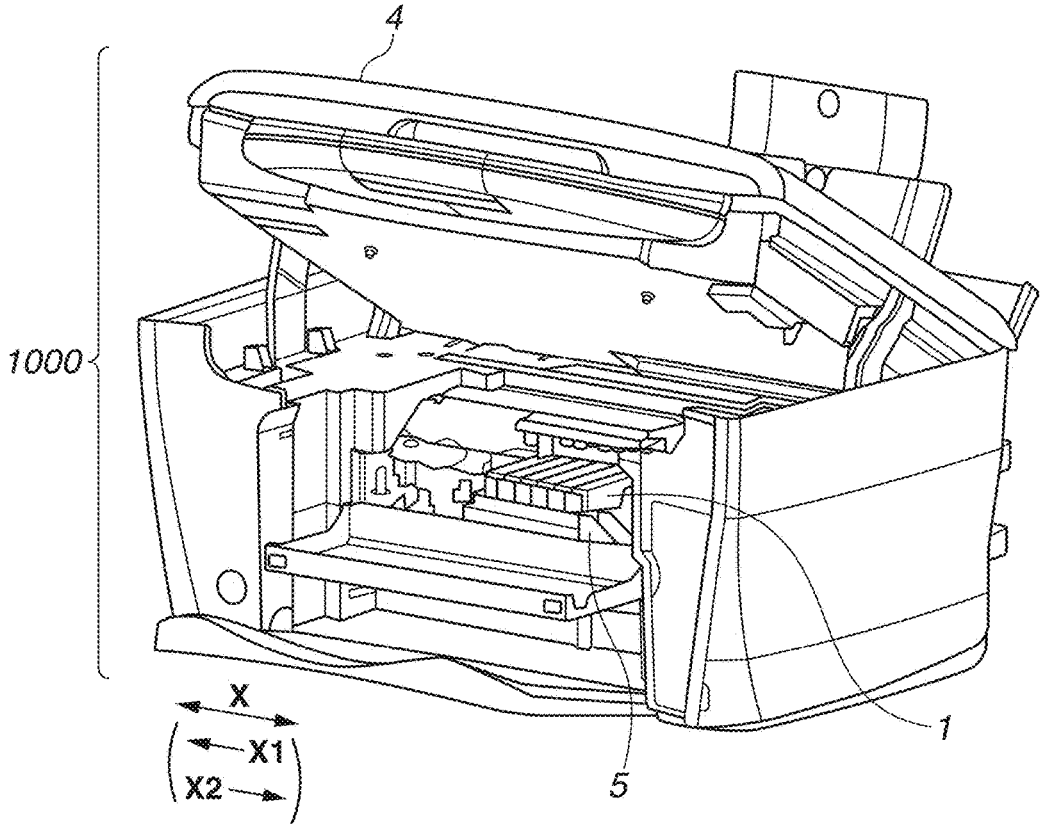
FIG. 1 is a perspective view of an inkjet recording apparatus applied in an exemplary embodiment.

FIG. 1 is a schematic diagram illustrating an internal configuration of an inkjet recording apparatus 1000 according to the present exemplary embodiment. FIG. 1 illustrates a state in which a top cover is lifted up.

The inkjet recording apparatus (hereinafter, also referred to as a printer or recording apparatus) 1000 according to the present exemplary embodiment includes a carriage 5 which reciprocates (scans back and forth) in an X direction (crossing direction). The carriage 5 is provided with a recording head 1 described below. In the present exemplary embodiment, the carriage 5 and the recording head 1 have a moving speed (scanning speed) of approximately 25 inches/sec. While the carriage 5 and the recording head 1 reciprocate, the recording head 1 discharges ink. An operation of recording image on a recording medium is performed accordingly.

The recording medium is fed from a feed tray of the printer 1000 and conveyed in a sub scanning direction crossing the X direction. In the present exemplary embodiment, a conveyance speed of the recording medium is approximately 5 inches/sec.

In the present exemplary embodiment, the scanning of the recording head 1 and the conveyance of the recording medium as described above are alternately repeated to complete recording on a sheet of recording medium. In the present exemplary embodiment, a one-pass recording system in which recording on a unit area on the recording medium is completed by one scan may be used. A multi-pass recording system in which recording on a unit area is completed by a plurality of times of scanning may be used.

Sheets used in the present exemplary embodiment have a thickness of approximately 0.3 mm. In such a case, a distance in a height direction between the recording head 1 and a sheet is approximately 1.0 mm. The printer 1000 is provided with a scanner 4 for capturing a recording image, on top of the printer 1000. The scanner 4 is integrated with the top cover of the printer 1000.

Figure 2:
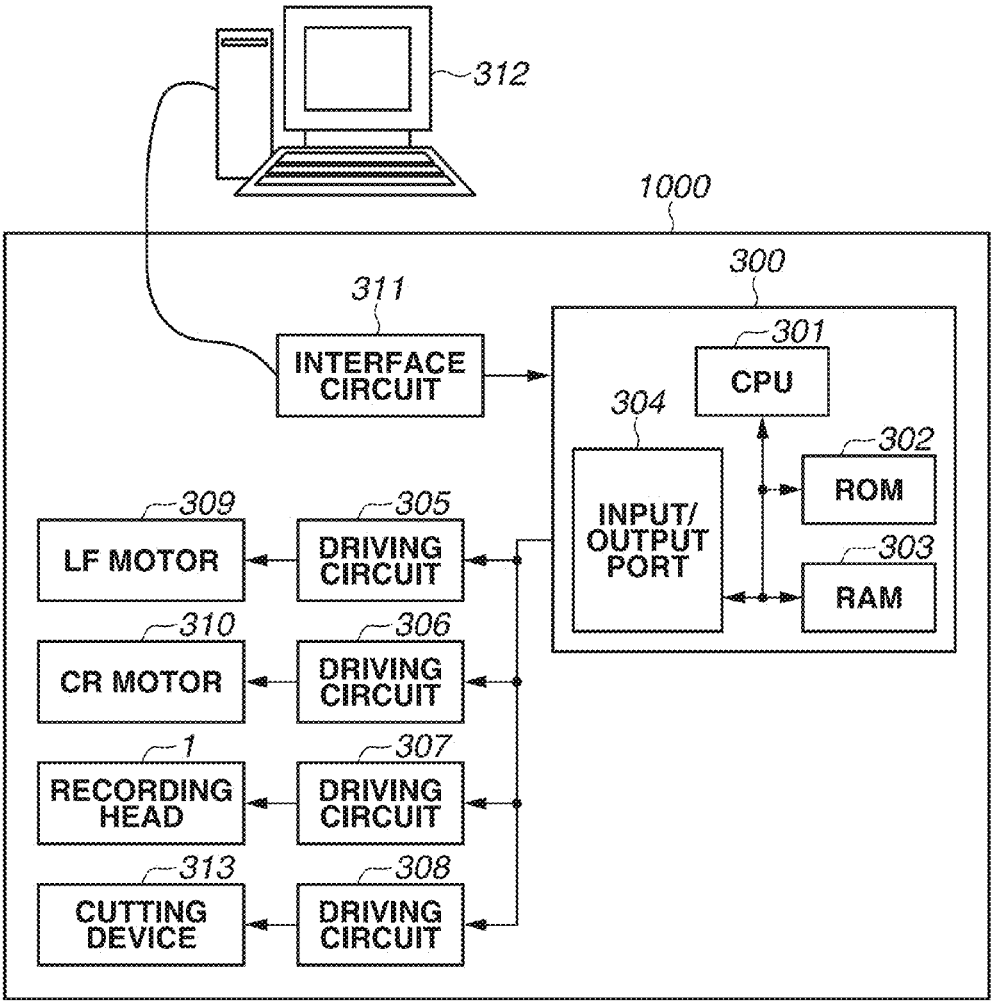
FIG. 2 is a schematic diagram illustrating a recording control system according to the exemplary embodiment.

FIG. 2 is a block diagram illustrating a schematic configuration of a control system in the printer 1000 according to the present exemplary embodiment. A main control unit 300 in the printer 1000 includes a central processing unit (CPU) 301, a read-only memory (ROM) 302, a random access memory (RAM) 303, and an input/output port 304. The CPU 301 performs processing operations for calculation, selection, determination, and control. The ROM 302 stores, for example, a control program to be executed by the CPU 301. The RAM 303 is used as a recording data buffer or the like. The ROM 302 further stores mask patterns described below. The input/output port 304 is connected with a conveyance motor (line feed (LF) motor) 309, a carriage motor (CR motor) 310, and driving circuits 305, 306, 307, and 308 for actuators in the recording head 1 and a cutting device 313 for cutting the recording medium. The main control unit 300 is connected to a personal computer (PC) 312, which serves as a host computer, via an interface circuit 311.

(Data Generation Processing)

Figure 3:
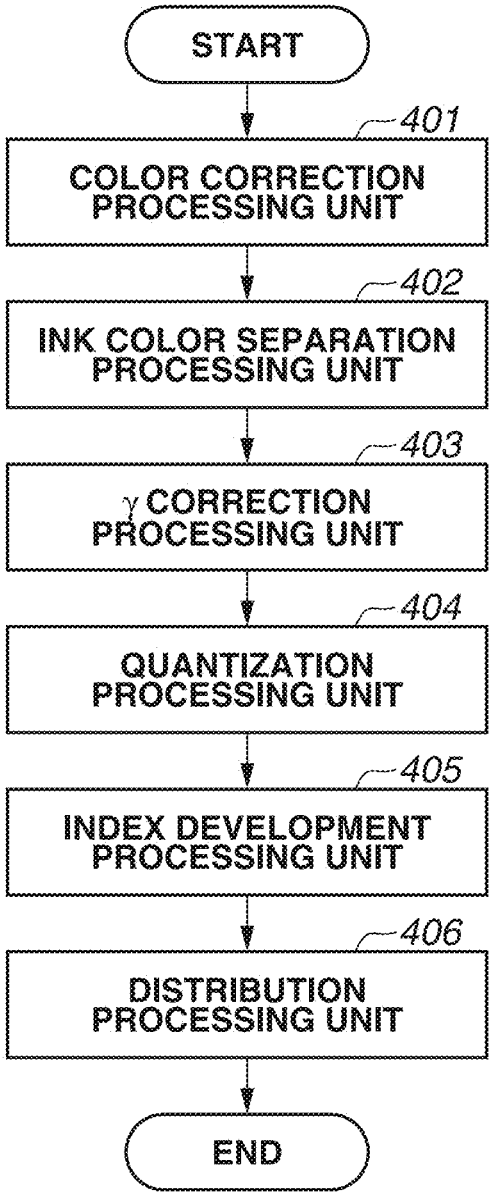
FIG. 3 is a diagram for describing a data processing process according to the exemplary embodiment.

FIG. 3 is a flowchart of processing for generating recording data used in recording performed by the CPU 301 according to the control program of the present exemplary embodiment. The control program is stored in the ROM 302 in advance.

Input image data is an 8-bit-per-color red, green, and blue (RGB) signal having a resolution of 600 dpi, with 256 tones per pixel. The data is initially transferred to a color correction processing unit 401, which applies processing for associating sRGB color space expressed by the PC 312 with a color space that the printer 1000 can express. More specifically, the color correction processing unit 401 refers to a three-dimensional lookup table (LUT) stored in the ROM 302 in advance, and converts the RGB 8-bit 256-valued signal into another RGB 8-bit 256-valued signal.

Next, an ink color separation processing unit 402 converts the data generated by the color correction processing unit 401 into data corresponding to ink colors used by the recording apparatus 1000. Specifically, the ink color separation processing unit 402 refers to a three-dimensional LUT stored in the ROM 302 in advance, and converts the RGB 8-bit 256-valued signal into 8-bit density signals of the respective ink colors.

The data separated by the ink colors is input to a γ correction processing unit 403, which corrects density values with respect to each ink color. γ correction refers to correction for establishing a linear relationship between the density of the input data and an optical density of the image expressed on the recording medium. Specifically, the γ correction processing unit 403 refers to a one-dimensional LUT stored in the ROM 302 in advance, and converts the 8-bit 256-valued density data of each ink color into 8-bit 256-valued density data.

A quantization processing unit 404 then performs quantization processing on the 8-bit 256-valued density data corresponding to each ink color and generates 2-bit four-valued quantization data corresponding to each ink color. In the present exemplary embodiment, the quantization processing is not limited to any particular method. A dithering method and an error diffusion method may be employed.

Next, the quantization data is transferred to an index development processing unit 405, in which the quantization data is converted into one-bit binary data. More specifically, the index development processing unit 405 generates binary data for determining whether to discharge ink to each pixel, by using an index pattern that defines the number and positions of ink droplets to be discharged to 2×2 pixels, a total of four pixels according to the value of the quantization data for a pixel group including the 2×2 pixels. The index pattern is stored in the ROM 302 in advance.

The binary data is then transferred to a distribution processing unit 406, which distributes the binary data to a plurality of times of scanning for a unit area. More specifically, corresponding to a different one of the plurality of times of scanning, the distribution processing unit 406 generates one-bit binary recording data used in each of the plurality of times of scanning, by using a plurality of mask patterns that define whether to allow discharge of ink to each pixel. The plurality of mask patterns is stored in the ROM 302 in advance. If recording is performed by the one-pass recording system, the processing of the distribution processing unit 406 is omitted.

While all the processing of the processing units 401 to 406 is described to be performed by the CPU 301 in the printer 1000, a CPU (not illustrated) in the PC 312 may perform part or all of the processing of the processing units 401 to 406.

(Recording Head)

Figure 4:
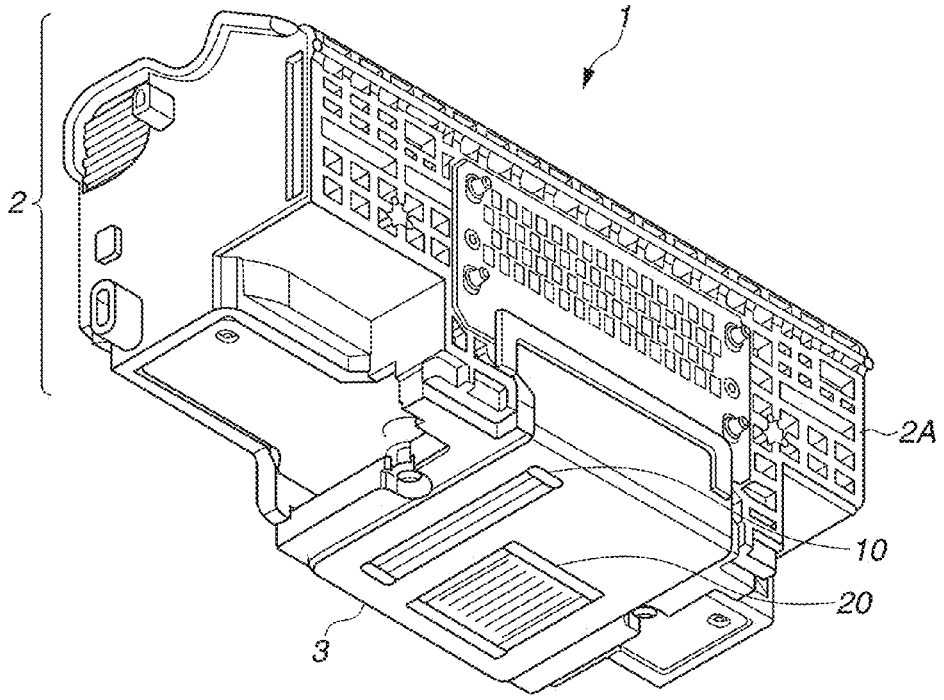
FIG. 4 is a perspective view of a recording head applied in the exemplary embodiment.

FIG. 4 is a perspective view illustrating the recording head 1 used in the present exemplary embodiment.

The recording head 1 according to the present exemplary embodiment includes an ink supply unit 2 and an ink discharge unit 3 which are integrally configured. The ink supply unit 2 includes a holding member 2A which holds ink tanks (not illustrated) for supplying ink.

The ink discharge unit 3 includes a chip (Bk chip) 10 for discharging a pigment black ink and a chip (Cl chip) 20 for discharging dye inks described below. The following description will be given mainly on the Cl chip 20.

Figure 5:
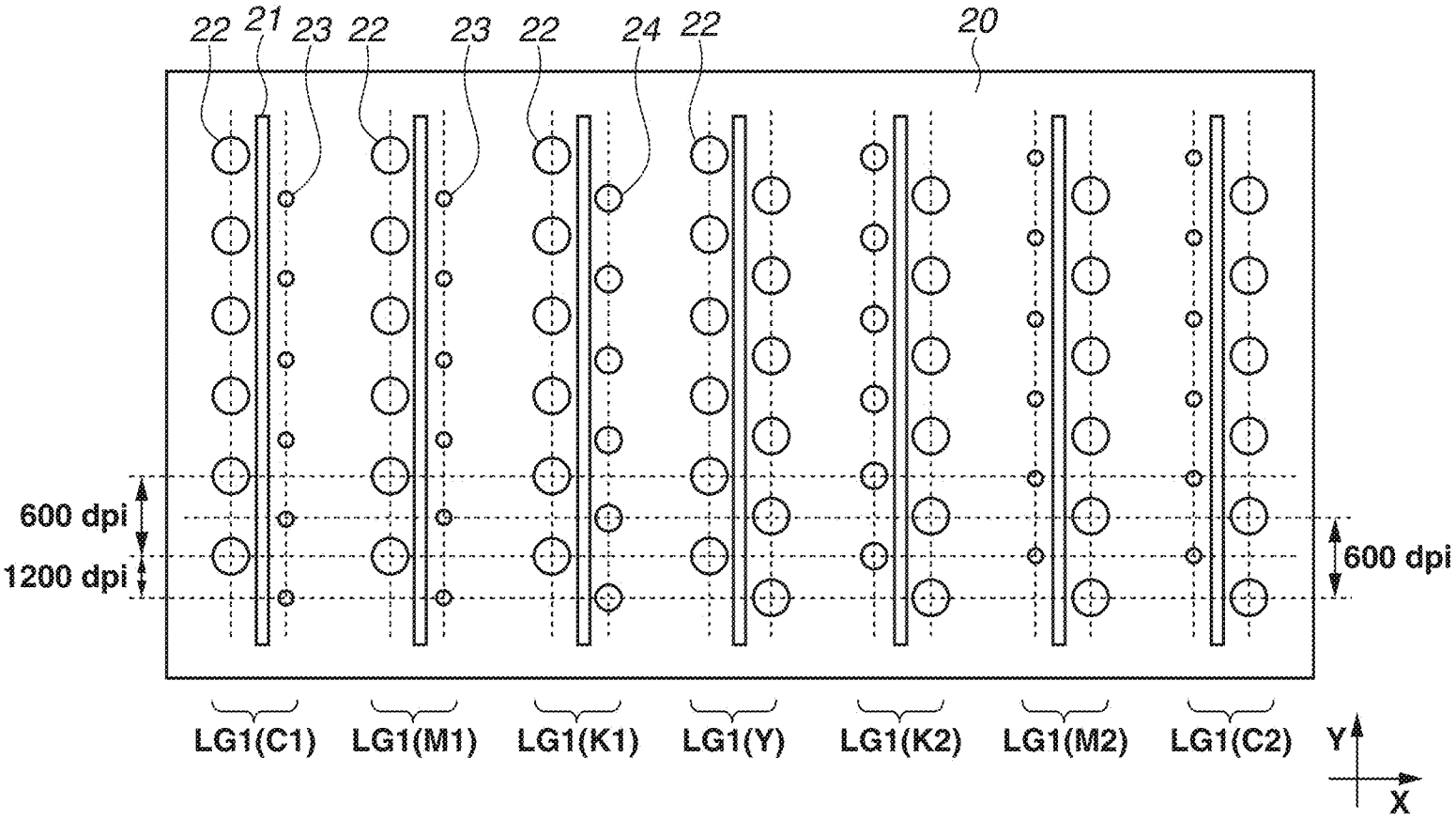
FIG. 5 is a diagram illustrating a surface of a chip in the recording head applied in the exemplary embodiment.
Figure 6A:
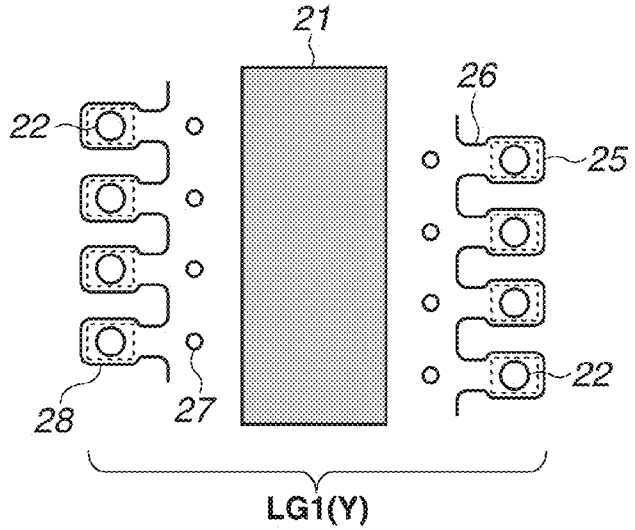
FIGS. 6A to 6C are transparent views near discharge ports in the recording head applied in the exemplary embodiment.
Figure 6B:
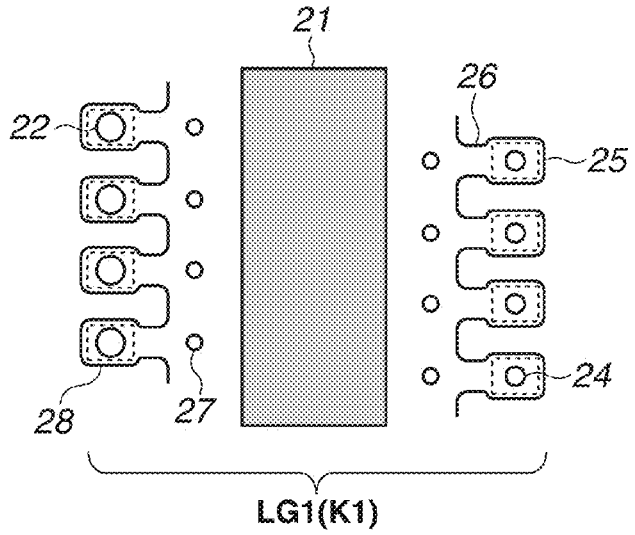
Figure 6C:
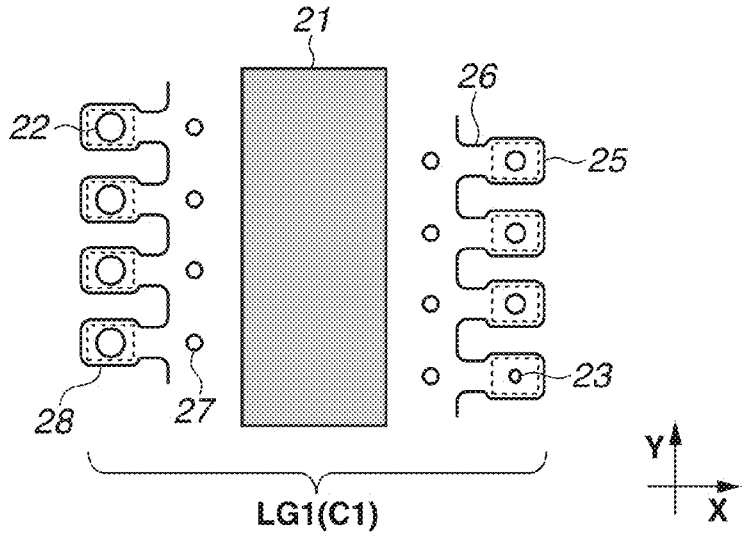

FIG. 5 is an enlarged view of the Cl chip 20 in the recording head 1 according to the present exemplary embodiment. FIGS. 6A to 6C are diagrams for describing an internal configuration of discharge port array units according to the present disclosure.

The Cl chip 20 according to the present exemplary embodiment includes a total of seven common ink chambers 21 which are connected to the ink supply unit 2. A discharge port array unit LG1 is formed for each common ink chamber 21. Each discharge port array unit LG1 includes a plurality of discharge port arrays. Discharge ports arranged in the discharge port arrays vary in diameter (discharge port diameter) from one discharge port array unit to another.

The discharge ports in the Cl chip 20 are opened in a nozzle plate connected to members constituting the common ink chambers 21 (hereinafter, also referred to as common ink chamber forming members). The common ink chamber forming members include electrothermal transducers (hereinafter, also referred to as heaters) 28 which are arranged in positions opposite to the respective discharge ports.

The discharge port array units LG1 in the Cl chip 20 will be described in detail below.

1. Discharge Port Array Unit of Yellow Ink

The Cl chip 20 according to the present exemplary embodiment includes only one discharge port array unit of yellow ink (LG1(Y)). The discharge port array unit LG1(Y) of yellow ink includes two discharge port arrays. FIG. 6A is a diagram illustrating details of the discharge port array unit LG1(Y) of yellow ink. The discharge port array unit LG1(Y) of yellow ink includes two discharge port arrays on both sides of the common ink chamber 21. The discharge port arrays each include discharge ports 22 which have a diameter of approximately 16 μm and discharge ink droplets having a relatively large size of approximately 5 pl. The discharge port arrays each include 264 discharge ports 22 arranged in a Y direction at pitches of 600 dpi (approximately 42.3 μm). The discharge port arrays are shifted from each other in the Y direction by a distance of 1200 dpi (approximately 21.2 μm).

As described above, the heaters 28 are arranged in the positions opposite to the discharge ports 22. Bubble forming chambers 25 are formed to surround the heaters 28. Ink channels 26 are formed to connect the bubble forming chambers 25 with the common ink chamber 21. Foreign substance inhibition pillars 27 are arranged to prevent foreign substances in the ink from entering the ink channels 26. In the other discharge port array units, the heaters 28, the bubble foaming chambers 25, the ink channels 26, and the foreign substance inhibition pillars 27 are similarly configured. A description thereof will thus be omitted.

2. Discharge Port Array Units of Black Ink

The Cl chip 20 according to the present exemplary embodiment includes two discharge port array units of black ink (LG1(K1) and LG1(K2)). The discharge port array units LG1(K1) and LG1(K2) of black ink include two discharge port arrays each.

FIG. 6B is a diagram illustrating details of the discharge port array unit LG1(K1) of black ink.

In the discharge port array unit LG1(K1) of black ink, a discharge port array including discharge ports 22 which have a diameter of approximately 16 μm and discharge ink droplets having a relatively large size of approximately 5 pl is arranged on one side (left) of the common ink chamber 21. A discharge port array including discharge ports 24 which have a diameter of approximately 12 μm and discharge ink droplets having a medium size of approximately 2 pl is arranged on the other side (right) of the common ink chamber 21. Such discharge port arrays each include 264 discharge portions 22 or 24 arranged in the Y direction at pitches of 600 dpi (approximately 42.3 μm). The discharge port arrays are shifted from each other in the Y direction by a distance of 1200 dpi (approximately 21.2 μm).

Like the discharge port array unit LG1(K1), the discharge port array unit LG1(K2) of black ink also includes a discharge port array including discharge ports 22 of approximately 16 μm in diameter and a discharge port array including discharge ports 24 of approximately 12 μm in diameter. The two discharge port array units LG1(K1) and LG1(K2) differ in that the arrangement of their respective two discharge port arrays is reversed in the X direction. Two discharge port arrays including discharge ports of the same diameter in the discharge port array units LG1(K1) and LG1(K2) are arranged in positions shifted from each other in the Y direction by a distance of 1200 dpi (approximately 21.2 μm).

3. Discharge Port Array Units of Cyan and Magenta Inks

The Cl chip 20 according to the present exemplary embodiment includes two discharge port array units of cyan ink (LG1(C1) and LG1(C2)). The discharge port array units LG1(C1) and LG1(C2) of cyan ink include two discharge port arrays each.

FIG. 6C is a diagram illustrating details of the discharge port array unit LG1(C1) of cyan ink.

In the discharge port array unit LG1(C1) of cyan ink, a discharge port array including discharge ports 22 which have a diameter of approximately 16 μm and discharge ink droplets having a relatively large size of approximately 5 pl is arranged on one side (left) of the common ink chamber 21. A discharge port array including discharge ports 23 which have a diameter of approximately 9 μm and discharge ink droplets having a relatively small size of approximately 1 pl is arranged on the other side (right) of the common ink chamber 21. Such discharge port arrays each include 264 discharge ports 22 or 23 arranged in the Y direction at pitches of 600 dpi (approximately 42.3 μm). The discharge port arrays are shifted from each other in the Y direction by a distance of 1200 dpi (approximately 21.2 μm).

Like the discharge port array unit LG1(C1), the discharge port array unit LG1(C2) of cyan ink includes a discharge port array including discharge ports 22 of approximately 16 μm in diameter and a discharge port array including discharge ports 23 of approximately 9 μm in diameter. The two discharge port array units LG1(C1) and LG1(C2) differ in that the arrangement of their respective two discharge port arrays is reversed in the X direction. Two discharge port arrays including discharge ports of the same diameter in the discharge port array units LG1(C1) and LG1(C2) are arranged in positions shifted from each other in the Y direction by a distance of 1200 dpi (approximately 21.2 μm).

Discharge port array units LG1(M1) and LG1(M2) of magenta ink have the same configuration as that of the discharge port array units LG1(C1) and LG1(C2) of cyan ink, respectively.

4. Summary of Configuration of Discharge Port Arrays in Discharge Port Array Units Table 1 shows a summary of the discharge port arrays arranged in the foregoing discharge port array units of respective color inks. For the sake of simplicity, in Table 1 and the following description, a discharge port array including discharge ports 22 having a diameter of approximately 16 μm may be referred to as a discharge port array having a large discharge port diameter. A discharge port array including discharge ports 24 having a diameter of approximately 12 μm may be referred to as a discharge port array having a medium discharge port diameter. A discharge port array including discharge ports 23 having a diameter of approximately 9 μm may be referred to as a discharge port array having a small discharge port diameter.

TABLE 1

| | | Number of discharge port arrays | | |
|---|---|---|---|---|
| Discharge port array unit | Number of discharge port array units | Discharge port diameter: large | Discharge port diameter: medium | Discharge port diameter: small |
| Yellow | 1 | 2 | 0 | 0 |
| Black | 2 | 1 | 1 | 0 |
| Cyan | 2 | 1 | 0 | 1 |
| Magenta | 2 | 1 | 0 | 1 |

Figure 7:
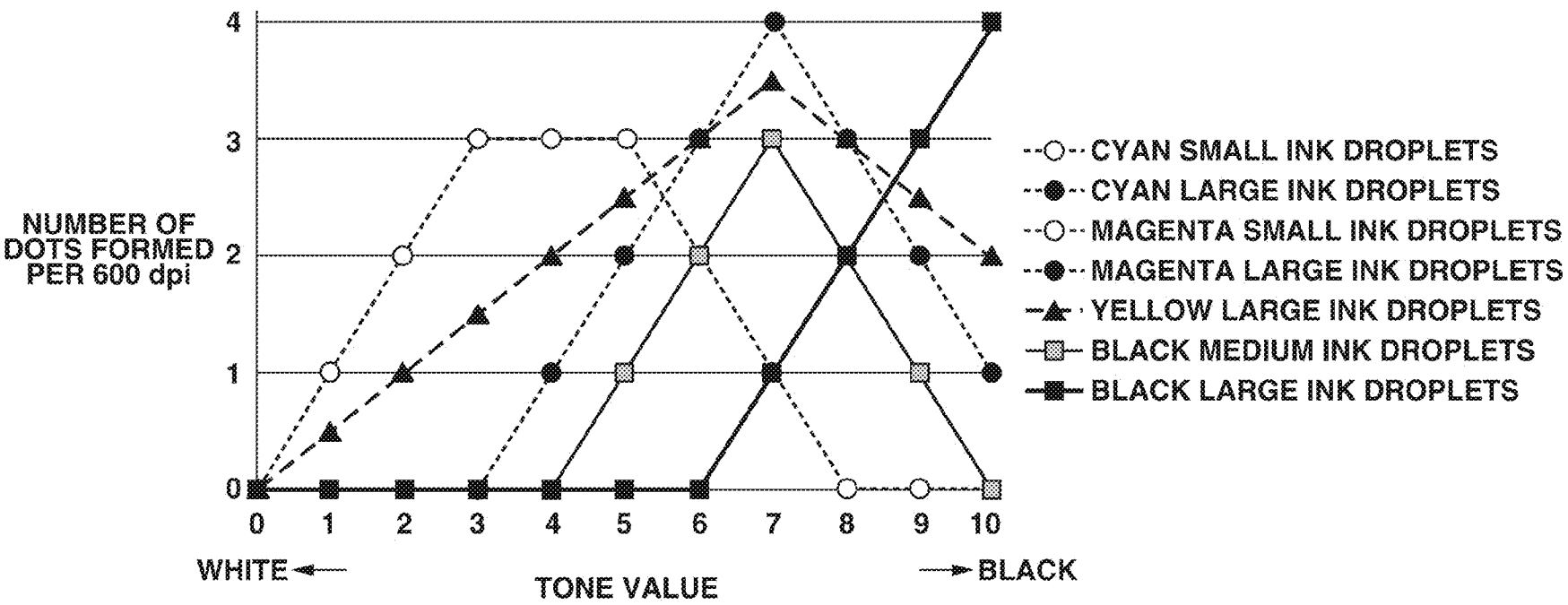
FIG. 7 is a chart illustrating a correlation between a tone value and the number of discharged ink droplets according to the exemplary embodiment.

FIG. 7 is a chart illustrating a correlation between a tone value of image data and the number of ink droplets discharged. Reasons for the configuration of the discharge port arrays in the discharge port array units of respective color inks according to the present exemplary embodiment will be described in detail below with reference to FIG. 7.

In FIG. 7, image data representing white, or (R, G, B)=(255, 255, 255), is defined to have a tone value=0. Image data representing black, or (R, G, B)=(0, 0, 0), is defined to have a tone value=10. Tones on the line from white to black through gray are equally divided into nine parts, which are defined to have tone values=1 to 9. In other words, all the tone values of 0 to 10 illustrated in FIG. 7 represent achromatic colors. The greater the tone value, the closer the represented color shifts from white to black. The vertical axis of FIG. 7 indicates the number of dots formed (the number of ink droplets discharged) per 600 dpi. In FIG. 7, ink droplets of each color ink discharged in approximately 5 pl from the discharge port arrays having a large discharge port diameter are represented as "large ink droplets". Ink droplets of approximately 2 pl discharged from the discharge port arrays having a medium discharge port diameter are represented as "medium ink droplets". Ink droplets of approximately 1 pl discharged from the discharge port arrays having a small discharge port diameter are represented as "small ink droplets".

In the present exemplary embodiment, there are two discharge port array units for each of black ink, cyan ink, and magenta ink. The two discharge port array units include discharge port arrays each having different discharge port diameters. The reason is that black ink, cyan ink, and magenta ink are relatively low in brightness and easily visible on a recording medium.

For example, in the present exemplary embodiment, if the tone value=2 as illustrated in FIG. 7, no cyan large ink droplet is used but two dots of cyan small ink droplets are formed.

If the tone value=2, less than two dots of cyan large ink droplets can reproduce a similar tone without using cyan small ink droplets. In such a case, since the size per formed dot is large, granularity becomes easily visible. In particular, since low-brightness ink, such as cyan ink, is easily visible in the first place, the granularity can be more noticeable.

In view of the foregoing, in the present exemplary embodiments, two discharge port arrays, namely, a discharge port array of large ink droplets and a discharge port array of ink droplets smaller than large ink droplets in size (small ink droplets or medium ink droplets) are provided for black, cyan, and magenta inks which are low in brightness.

On the other hand, yellow ink is high in brightness and less visible on a recording medium. The foregoing granularity is less noticeable. The present exemplary embodiment therefore includes only discharge port arrays of large ink droplets for yellow ink. Since no discharge port array of small or medium ink droplets needs to be provided for yellow ink, the number of discharge port array units can be reduced. With only one discharge port array unit LG1(Y), the Cl chip 20 can be reduced in size.

In the present exemplary embodiment, discharge port arrays of only large and medium ink droplets, but not a discharge port array of small ink droplets, are provided for black ink.

Brightness of black ink is even lower than brightness of cyan and magenta inks, and therefore, when the foregoing granularity is taken into consideration, a discharge port array of small ink droplets should be provided for black ink. However, in the present exemplary embodiment, black ink is not used at small tone values, and cyan, magenta, and yellow inks are used to reproduce the achromatic colors. For such a reason, no discharge port array of small ink droplets needs to be provided for black ink.

Specifically, for example, in a case where the tone value=2 as illustrated in FIG. 7, black ink is not used, and cyan small ink droplets, magenta small ink droplets, and a yellow large ink droplet are applied to reproduce the achromatic color.

A similar tone can be reproduced by applying black small ink droplets without using cyan, magenta, and yellow inks. However, if achromatic color with such a low tone value is reproduced by using only black ink, only a small amount of black ink is discharged. This increase the area to which no ink is applied on the recording medium, i.e., the area of the surface (paper white) of the recording medium, and favorable image quality cannot to be obtained.

In view of the foregoing, in the present exemplary embodiment, the use of black ink is deliberately avoided, and cyan, magenta and yellow inks are used to reproduce small tone values. An ink-covered area (area factor) is thereby increased to minimize the paper white area. For such a reason, the Cl chip 20 of the present exemplary embodiment includes no discharge port array of black small ink droplets.

As illustrated in FIG. 7, black medium ink droplets start to be used at a tone value=5. At a somewhat high tone value like this, other inks are also used in relatively large amounts. The paper white area therefore will not increase much. Black medium ink droplets can thus be used with a relatively high area factor, and the use of black ink can provide favorable achromatic color. For such a reason, the Cl chip 20 includes discharge port arrays of black medium ink droplets.

5. Order of Arrangement of Discharge Port Array Units in Chip

As illustrated in FIG. 5, the discharge port array units are arranged in the chip 20 of the present exemplary embodiment in the following order from the left: the discharge port array unit LG1(C1) of cyan ink, the discharge port array unit LG1(M1) of magenta ink, the discharge port array unit LG1(K1) of black ink, the discharge port array unit LG1(Y) of yellow ink, the discharge port array unit LG1(K2) of black ink, the discharge port array unit LG1(M2) of magenta ink, and the discharge port array unit LG1(C2) of cyan ink.

The reason for such order of arrangement of the discharge port array units is described in detail below.

In the present exemplary embodiment, recording is performed by reciprocal scanning. To reduce a color difference between an area recorded by forward scanning and an area recorded by backward scanning on the recording medium, a desirable arrangement of the discharge port array units of each color is line symmetrical in the X direction.

For example, the Cl chip 20 used in the present exemplary embodiment illustrated in FIG. 5 includes the discharge port array unit LG1(Y) of yellow ink at the center. From the center to outside the Cl chip 20, the discharge port array units LG1(K1) and LG1(K2) of black ink, the discharge port array units LG1(M1) and LG1(M2) of magenta ink, and then the discharge port array units LG1(C1) and LG1(C2) of cyan ink are arranged on the left side and the right side of the discharge port array unit LG1(Y) of yellow ink, respectively. In such a manner, the discharge port array units are arranged in perfect symmetry.

For comparison, an asymmetrical arrangement will be described. For example, suppose that the discharge port array units for cyan and magenta inks are arranged in the following order of arrangement from the left in the X direction: the discharge port array unit LG1(C1) of cyan ink, the discharge port array unit LG1(M1) of magenta ink, the discharge port array unit LG1(C2) of cyan ink, and the discharge port array unit LG1(M2) of magenta ink. In such a case, forward scanning (scanning from left to right) applies magenta ink (LG1(M2)), cyan ink (LG1(C2)), magenta ink (LG1(M1)), and cyan ink (LG1(C1)) to the recording medium in order. On the other hand, backward scanning (scanning from right to left) applies cyan ink (LG1(C1)), magenta ink (LG1(M1)), cyan ink (LG1(C2)), and magenta ink (LG1(M2)) in order. If the discharge port array units of each color ink are not symmetrically arranged, the order of application of the ink varies between forward scanning and backward scanning. If the color inks are applied to the same area on the recording medium at a high tone value, the order of superposition of the color inks varies between forward scanning and backward scanning. The resulting color then varies slightly between forward scanning and backward scanning, and thus leads a drop in image quality.

Meanwhile, in the case illustrated in FIG. 5, the discharge port array units of each color ink are symmetrically arranged. The application order of, for example, only cyan and magenta inks in this case is the following order. Forward scanning (from left to right) applies cyan ink (LG1(C2)), magenta ink (LG1(M2)), magenta ink (LG1(M1)), and cyan ink (LG1(C1)) in order. Backward scanning applies cyan ink (LG1(C1)), magenta ink (LG1(M1)), magenta ink (LG1(M2)), and cyan ink (LG1(C2)) in order. Since the order of application of the inks is the same between forward scanning and backward scanning, a color difference is less likely to occur between such forward and backward scanning.

In the present exemplary embodiment, the discharge port array units are arranged so that the discharge port array units LG1(C1) and LG1(C2) of cyan ink and the discharge port array units LG1(M1) and LG1(M2) of magenta ink are not adjacent to the discharge port array unit LG1(Y) of yellow ink, and the discharge port array units LG1(K1) and LG1(K2) of black ink are adjacent to the discharge port array unit LG1(Y) of yellow ink. The reason is to make the landing positions of ink droplets discharged from the other discharge port array units less likely to deviate even if an airflow occurs in association with discharge of yellow ink.

As illustrated in FIG. 5 and Table 1, in the present exemplary embodiment, the discharge port array unit LG1(Y) of yellow ink includes two discharge port arrays having a large discharge port diameter. The airflow associated with the discharge of the ink can thus be strong, compared to those of the other discharge port array units which include discharge port arrays having a medium or small discharge port diameter.

In addition, the Cl chip 20 includes only one discharge port array unit of yellow ink, which is fewer than the numbers (two) of respective discharge port array units of cyan, magenta, and black inks. While cyan, magenta, and black inks each can be discharged from two discharge port array units in a distributed manner, yellow ink can only be discharged from one discharge port array unit. The amount of discharge of yellow ink per discharge port array unit is therefore larger than those of cyan, magenta, and black inks. Consequently, the airflow can be intensified.

As described above, the discharge port array unit LG1(Y) of yellow ink can easily generate a strong airflow associated with the discharge of the ink. Discharge port arrays having a small discharge port diameter are susceptible to an airflow. If such discharge port arrays are arranged near the discharge port array unit LG1(Y) of yellow ink, the landing positions of the ink can deviate greatly due to the effect of the strong airflow.

As described above, in the present exemplary embodiment, achromatic colors with small tone values are reproduced by using cyan, magenta, and yellow inks. For black ink, a discharge port array having a small discharge port diameter is therefore not included. The discharge port array units LG1(K1) and LG1(K2) of black ink include only discharge port arrays having a medium discharge port diameter at the minimum. Thus, even if the discharge port array units LG1(K1) and LG1(K2) of black ink are arranged to be adjacent to the discharge port array unit LG1(Y) of yellow ink, black ink is thus less susceptible to the occurrence of a strong airflow. For such a reason, in the present exemplary embodiment, the discharge port array units LG1(K1) and LG1(K2) of black ink are arranged to be adjacent to the discharge port array unit LG1(Y) of yellow ink.

According to such a configuration, ink droplets discharged from the discharge port arrays having a small discharge port diameter are less susceptible to an airflow associated with the discharge of ink from other discharge port arrays. This enables recording to be performed while suppressing a drop in image quality.

In the foregoing first exemplary embodiment, the recording head 1 is described in which the two discharge port array units LG1(M1) and LG1(M2) of magenta ink are arranged between the two discharge port array units LG1(C1) and LG1(C2) of cyan ink. However, other modes may be employed. As described above, such a configuration is intended to reduce a color difference between forward scanning and backward scanning, but not to achieve what the present disclosure is directed to, namely, reducing deviations in the landing positions of ink droplets discharged from the discharge port arrays having a small discharge port diameter due to the effect of an airflow associated with the discharge of ink from other discharge port arrays. For example, suppose that the discharge port array units LG1(C1) and LG1(C2) of cyan ink and the discharge port array units LG1(M1) and LG1(M2) of magenta ink are not symmetrically arranged. Even in such a case, an effect of an exemplary embodiment of the present disclosure can be obtained if the discharge port array units LG1(K1) and LG1(K2) of black ink are arranged to be adjacent to the discharge port array unit LG1(Y) of yellow ink.

It will be understood, however, that the discharge port array units LG1(C1) and LG1(C2) of cyan ink and the discharge port array units LG1(M1) and LG1(M2) of magenta ink are desirably symmetrically arranged in view of reducing a color difference between forward scanning and backward scanning. From the viewpoint of reducing a color difference between forward scanning and backward scanning, the discharge port color units of each color ink have only to be symmetrically arranged. For example, a recording head in which the two discharge port array units LG1(C1) and LG1(C2) of cyan ink are arranged between the two discharge port array units LG1(M1) and LG1(M2) of magenta ink can provide the same effect.

In the foregoing first exemplary embodiment, discharge port arrays having a small discharge port diameter are not used for black ink. However, other modes of embodiment may be employed. As described above, the reason for the nonuse of black small ink droplets is that black color can be reproduced by mixing the colors of cyan, magenta, and yellow inks. In reproducing small tone values, desirable image quality can be obtained using cyan, magenta, and yellow ink droplets, compared to the case using black small ink droplets which increase the paper white area.

From the same reason, multiple color that can be reproduced by using a plurality of color inks is desirably reproduced by color mixing at small tone values. For multiple color, discharge port arrays of small ink droplets do not need to be included. Similar effects to those of the present exemplary embodiment can thus be obtained by arranging discharge port array units of multiple color to be adjacent to a discharge port array unit that generates a strong airflow, e.g., the discharge port array unit LG1(Y) of yellow ink.

Examples of multiple color ink include red ink (which can be reproduced by using magenta and yellow inks), green ink (which can be reproduced by using yellow and cyan inks), blue ink (which can be reproduced by using cyan and magenta inks), and gray ink (which can be reproduced by using magenta, yellow, and cyan inks).

In the foregoing first exemplary embodiment, the discharge port array units LG1(C1) and LG1(C2) of cyan ink and the discharge port array units LG1(M1) and LG1(M2) of magenta ink are provided so that the discharge port arrays having a small discharge port diameter are arranged to be closer to the discharge port array unit LG1(Y) of yellow ink (to the center side in the chip 20) than the discharge port arrays having a large discharge port diameter are. However, the order may be reversed. Theoretically, the discharge port arrays having a small discharge port diameter are desirably arranged to be farther from the discharge port array unit LG1(Y) of yellow ink than the discharge port arrays having a large discharge port diameter are, since small ink droplets become less susceptible to the airflow.

In fact, the distance between common ink chambers 21 adjacent to each other in the Cl chip 20 is approximately 1.5 mm. The distance between a discharge port array on one side of a common ink chamber 21 and a discharge port array on the other side is as sufficiently small as approximately 0.25 mm. The order of arrangement of two discharge port arrays in each of the discharge port array units LG1(C1), LG1(C2), LG1(M1), and LG1(M2) therefore does not have much impact on the reduction of landing position deviations of ink due to an airflow.

In the foregoing first exemplary embodiment, the discharge port array units of cyan and magenta inks include a discharge port array having a large discharge port diameter and a discharge port array having a small discharge port diameter each.

In a second exemplary embodiment, discharge port array units of cyan and magenta inks include a total of three discharge port arrays each. The three discharge port arrays include one having a large discharge port diameter, one having a small discharge port, and one having a medium discharge port diameter.

A description of portions similar to those of the foregoing first exemplary embodiment will be omitted.

Figure 8:
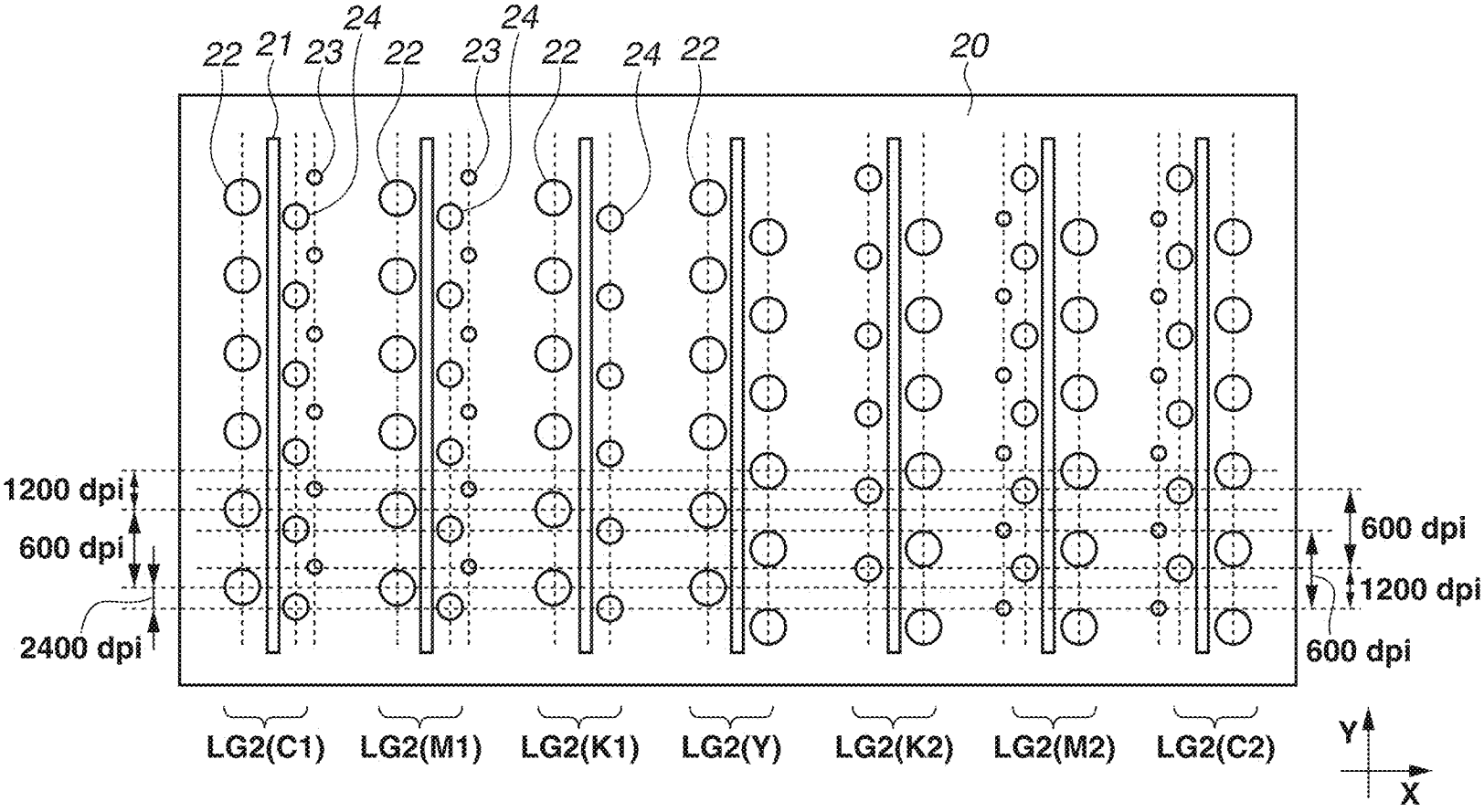
FIG. 8 is a diagram illustrating a surface of a chip in a recording head applied in another exemplary embodiment.
Figure 9:
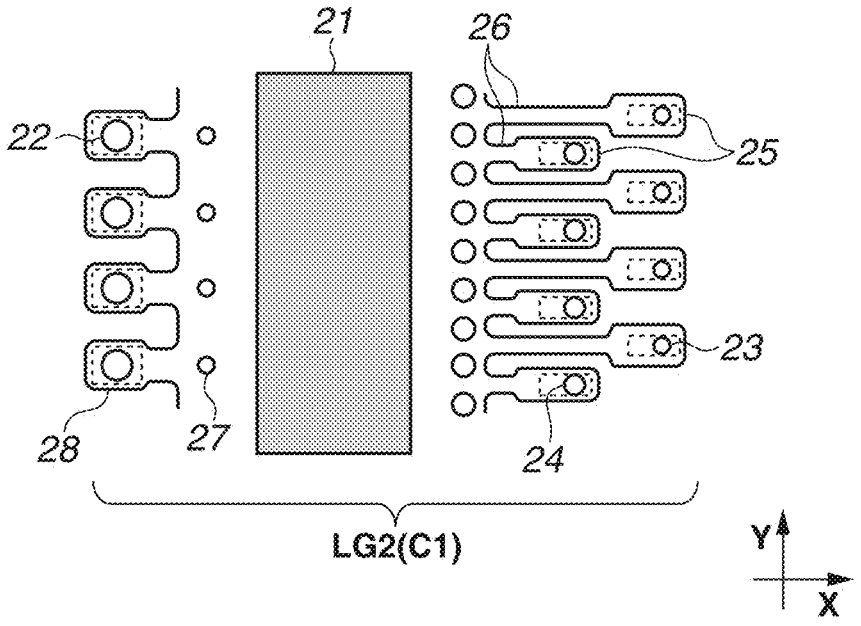
FIG. 9 is a transparent view near discharge ports in the recording head applied in the exemplary embodiment.

FIG. 8 is an enlarged view of the Cl chip 20 in the recording head 1 according to the present exemplary embodiment. FIG. 9 is a diagram for describing an internal configuration of a discharge port array unit of cyan ink according to the present exemplary embodiment.

A comparison between the Cl chip 20 illustrated in FIG. 8, used in the present exemplary embodiment, and the Cl chip 20 illustrated in FIG. 5, used in the first exemplary embodiment, shows that the Cl chip 20 according to the present exemplary embodiment is similar to the Cl chip 20 according to the first exemplary embodiment in the order of arrangement of discharge port array units and the configuration of discharge port array units LG2(K1) and LG2(K2) of black ink and a discharge port array unit LG2(Y) of yellow ink.

The Cl chip 20 used in the present exemplary embodiment differs from the Cl chip 20 used in the first exemplary embodiment in that discharge port array units LG2(C1) and LG2(C2) of cyan ink and discharge port array units LG2(M1) and LG2(M2) of magenta ink each further include a discharge port array including discharge ports 24 having a medium discharge port diameter, in addition to a discharge port array including discharge ports 22 having a large discharge port diameter and a discharge port array including discharge ports 23 having a small discharge port diameter.

Details are described below.

1. Discharge Port Array Units of Cyan and Magenta Inks

The Cl chip 20 according to the present exemplary embodiment includes two discharge port array units of cyan ink (LG2(C1) and LG2(C2)). The discharge port array units LG2(C1) and LG2(C2) of cyan ink include three discharge port arrays each.

As illustrated in FIG. 9, in the discharge port array unit LG2(C1) of cyan ink, a discharge port array including discharge ports 22 which have a diameter of approximately 16 μm and discharge ink droplets having a relatively large size of approximately 5 pl is arranged on one side (left) of the common ink chamber 21. Two discharge port arrays are arranged on the other side (right) of the common ink chamber 21. One is a discharge port array including discharge ports 24 which have a diameter of approximately 12 μm and discharge ink droplets having a medium size of approximately 2 pl. This discharge port array is arranged in a position closer to the common ink chamber 21. The other is a discharge port array including discharge ports 23 which have a diameter of approximately 9 μm and discharge ink droplets having a relatively small size of approximately 1 pl. This discharge port array is arranged in a position far from the common ink chamber 21.

The discharge port arrays each include 264 discharge ports 22, 23, or 24 which are arranged in the Y direction at pitches of 600 dpi (approximately 42.3 μm). The discharge port array including the discharge ports 22 having a discharge port diameter of approximately 16 μm and the discharge port array including the discharge ports 24 having a discharge port diameter of approximately 12 μm are shifted from each other in the Y direction by a distance of 2400 dpi (approximately 10.6 μm). The discharge port array including the discharge ports 24 having a discharge port diameter of approximately 12 μm and the discharge port array including the discharge port 23 having a discharge port diameter of approximately 9 μm are shifted from each other in the Y direction by a distance of 1200 dpi (approximately 21.2 μm).

Like the discharge port array unit LG2(C1), the discharge port array unit LG2(C2) of cyan ink includes a discharge port array having a discharge port diameter of approximately 16 μm, a discharge port array having a discharge port diameter of approximately 12 μm, and a discharge port array having a discharge port diameter of approximately 9 μm. The two discharge port array units LG2(C1) and LG2(C2) differ in that the arrangement of the respective three discharge port arrays in the X direction is reversed. Two discharge port arrays including discharge ports having the same diameter in the discharge port array units LG2(C1) and LG2(C2) are arranged in positions shifted from each other in the Y direction by a distance of 1200 dpi (approximately 21.2 μm).

The discharge port array units LG2(M1) and LG2(M2) of magenta ink have the same configuration as that of the discharge port array units LG2(C1) and LG2(C2) of cyan ink, respectively.

2. Summary of Configuration of Discharge Port Arrays in Discharge Port Array Units Table 2 shows a summary of the discharge port arrays arranged in the foregoing discharge port array units of the respective color inks.

TABLE 2

| | | Number of discharge port arrays | | |
|---|---|---|---|---|
| Discharge port array unit | Number of discharge port array units | Discharge port diameter: large | Discharge port diameter: medium | Discharge port diameter: small |
| Yellow | 1 | 2 | 0 | 0 |
| Black | 2 | 1 | 1 | 0 |
| Cyan | 2 | 1 | 1 | 1 |
| Magenta | 2 | 1 | 1 | 1 |

As can be seen from Table 2, in the present exemplary embodiment, three discharge port arrays, namely, a discharge port array of small ink droplets, a discharge port array of medium ink droplets, and a discharge port array of large ink droplets are provided for both cyan ink and magenta ink. To reproduce low tones, small ink droplets are mainly used for recording. To reproduce medium tones, medium ink droplets are mainly used. To reproduce high tones, large ink droplets are mainly used. In such a manner, as far as cyan and magenta inks are concerned, recording can be performed in a wider tone range and with less noticeable granularity than with the recording head 1 according to the first exemplary embodiment.

3. Order of Arrangement of Discharge Portion Array Units in Chip

As illustrated in FIG. 8, the discharge port array units are arranged in the Cl chip 20 according to the present exemplary embodiment in the following order from the left: the discharge port array unit LG2(C1) of cyan ink, the discharge port array unit LG2(M1) of magenta ink, the discharge port array unit LG2(K1) of black ink, the discharge port array unit LG2(Y) of yellow ink, the discharge port array unit LG2(K2) of black ink, the discharge port array unit LG2(M2) of magenta ink, and the discharge port array unit LG2(C2) of cyan ink.

Like the first exemplary embodiment, the reason of such an arrangement is to reduce a color difference between forward scanning and backward scanning and suppress landing position deviations due to an airflow. More specifically, to reduce a color difference between forward scanning and backward scanning, the discharge port array units according to the present exemplary embodiment are arranged so that the discharge port array units are line symmetrical in the X direction. The discharge port array unit LG2(Y) of yellow ink may generate a strong airflow when discharging ink. The discharge port array units are then arranged so that the discharge port array units LG2(C1) and LG2(C2) of cyan ink and the discharge port array units LG2(M1) and LG2(M2) of magenta ink including discharge port arrays of small ink droplets are not adjacent to the discharge port array unit LG2(Y) of yellow ink, and the discharge port array units LG2(K1) and LG2(K2) of black ink including no discharge port array of small ink droplets are adjacent to the discharge port array unit LG2(Y) of yellow ink.

According to such a configuration, the same effects as those of the first exemplary embodiment can be obtained even if a discharge port array unit includes three or more discharge port arrays having respective different discharge port diameters.

In the foregoing first and second exemplary embodiments, the recording head 1 includes the discharge port array units of cyan, magenta, yellow, and black inks.

In a third exemplary embodiment, a discharge port array unit of gray ink is further included in addition to the discharge port array units of cyan, magenta, yellow, and black inks.

A description of portions similar to those of the foregoing first and second exemplary embodiments will be omitted.

Figure 10:
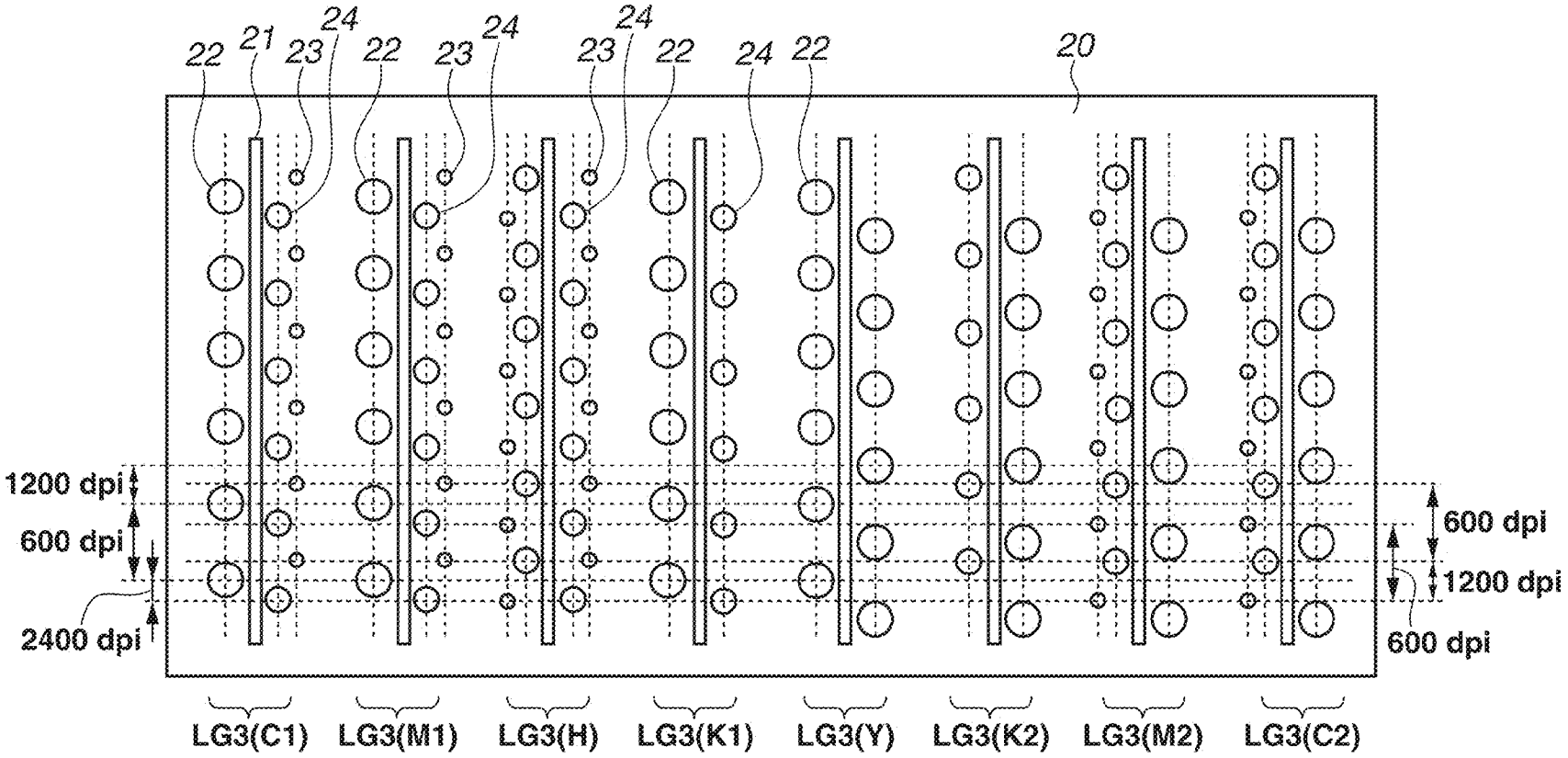
FIG. 10 is a diagram illustrating a surface of a chip in a recording head applied in yet another exemplary embodiment.
Figure 11:
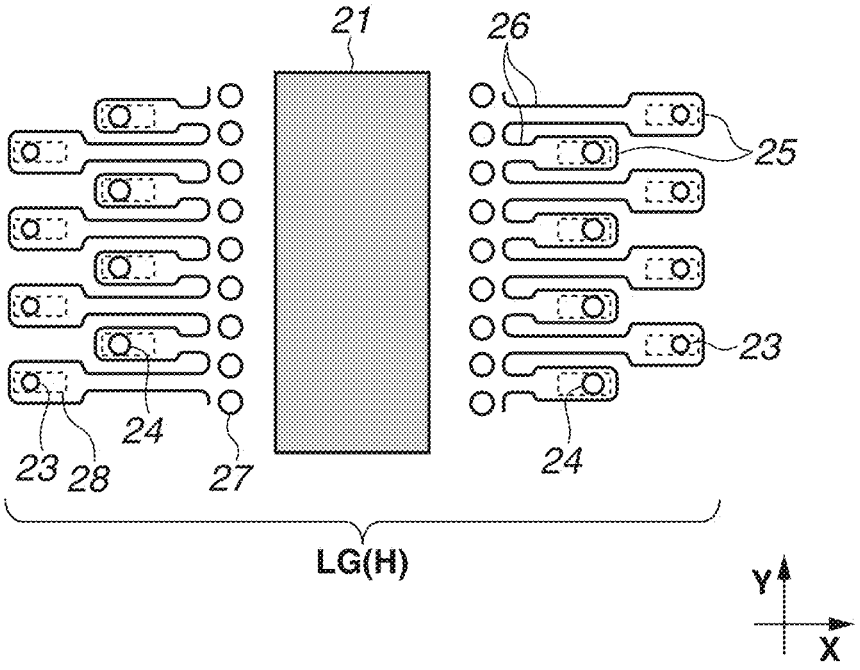
FIG. 11 is a transparent view near discharge ports in the recording head applied in the exemplary embodiment.

FIG. 10 is an enlarged view of the Cl chip 20 in the recording head 1 according to the present exemplary embodiment. FIG. 11 is a diagram for describing an internal configuration of the discharge port array unit of gray ink according to the present exemplary embodiment.

A comparison between the Cl chip 20 illustrated in FIG. 10, used in the present exemplary embodiment, and the Cl chip 20 illustrated in FIG. 8, used in the second exemplary embodiment, shows that the Cl chip 20 according to the present exemplary embodiment is similar to the Cl chip 20 according to the second exemplary embodiment in the configuration of discharge port array units LG3(C1) and LG3(C2) of cyan ink, discharge port array units LG3(M1) and LG3(M2) of magenta ink, discharge port array units LG3(K1) and LG3(K2) of black ink, and a discharge port array unit LG3(Y) of yellow ink.

The Cl chip 20 used in the present exemplary embodiment differs from the Cl chip 20 used in the second exemplary embodiment in that a discharge port array unit LG3(H) of gray ink is further included. Since the discharge port array unit LG3(H) of gray ink is added, the order of arrangement of the discharge port array units also differs from that in the second exemplary embodiment.

Details are described below.

1. Discharge Port Array Unit of Gray Ink

The Cl chip 20 according to the present exemplary embodiment includes one discharge port array unit of gray ink (LG3(H)). The discharge port array unit LG3(H) of gray ink includes four discharge port arrays.

As illustrated in FIG. 11, the discharge port array unit LG3(H) of gray ink includes two discharge port arrays on one side (left) of the common ink chamber 21. One is a discharge port array including discharge ports 24 which have a diameter of approximately 12 μm and discharge ink droplets having a medium size of approximately 2 pl. This discharge port array is arranged in a position closer to the common ink chamber 21. The other is a discharge port array including discharge ports 23 which have a diameter of approximately 9 μm and discharge ink droplets having a relatively small size of approximately 1 pl. This discharge port array is arranged in a position far from the common ink chamber 21. The same applies to the other side (right side) of the common ink chamber 21. There are arranged two discharge port arrays, including one having a discharge port diameter of approximately 12 μm and one having a discharge port diameter of approximately 9 μm. In such a manner, the discharge port array unit LG3(H) of gray ink includes a total of four discharge port arrays, including two discharge port arrays having a discharge port diameter of approximately 12 μm and two discharge port arrays having a discharge port diameter of approximately 9 μm.

The discharge port arrays each include 264 discharge ports 23 or 24 which are arranged in the Y direction at pitches of 600 dpi (approximately 42.3 μm). Two discharge port arrays lying on the same side of the common ink chamber 21 (a discharge port array having a discharge port diameter of approximately 9 μm and a discharge port array having a discharge port diameter of approximately 12 μm) are shifted from each other in the Y direction by a distance of 1200 dpi (approximately 21.2 μm).

2. Summary of Configuration of Discharge Port Arrays in Discharge Port Array Units Table 3 shows a summary of the discharge port arrays arranged in the foregoing discharge port array units of the respective color inks.

TABLE 3

| | | Number of discharge port arrays | | |
|---|---|---|---|---|
| Discharge port array unit | Number of discharge port array units | Discharge port diameter: large | Discharge port diameter: medium | Discharge port diameter: small |
| Yellow | 1 | 2 | 0 | 0 |
| Black | 2 | 1 | 1 | 0 |
| Cyan | 2 | 1 | 1 | 1 |
| Magenta | 2 | 1 | 1 | 1 |
| Gray | 1 | 0 | 2 | 2 |

As can be seen from Table 3, in the present exemplary embodiment, gray ink is further used for recording, in addition to cyan, magenta, yellow, and black inks. In the present exemplary embodiment, the amounts of discharge of the inks (the numbers of ink droplets discharged) at each tone are therefore different from those of the first exemplary embodiment illustrated in FIG. 7.

Figure 12:
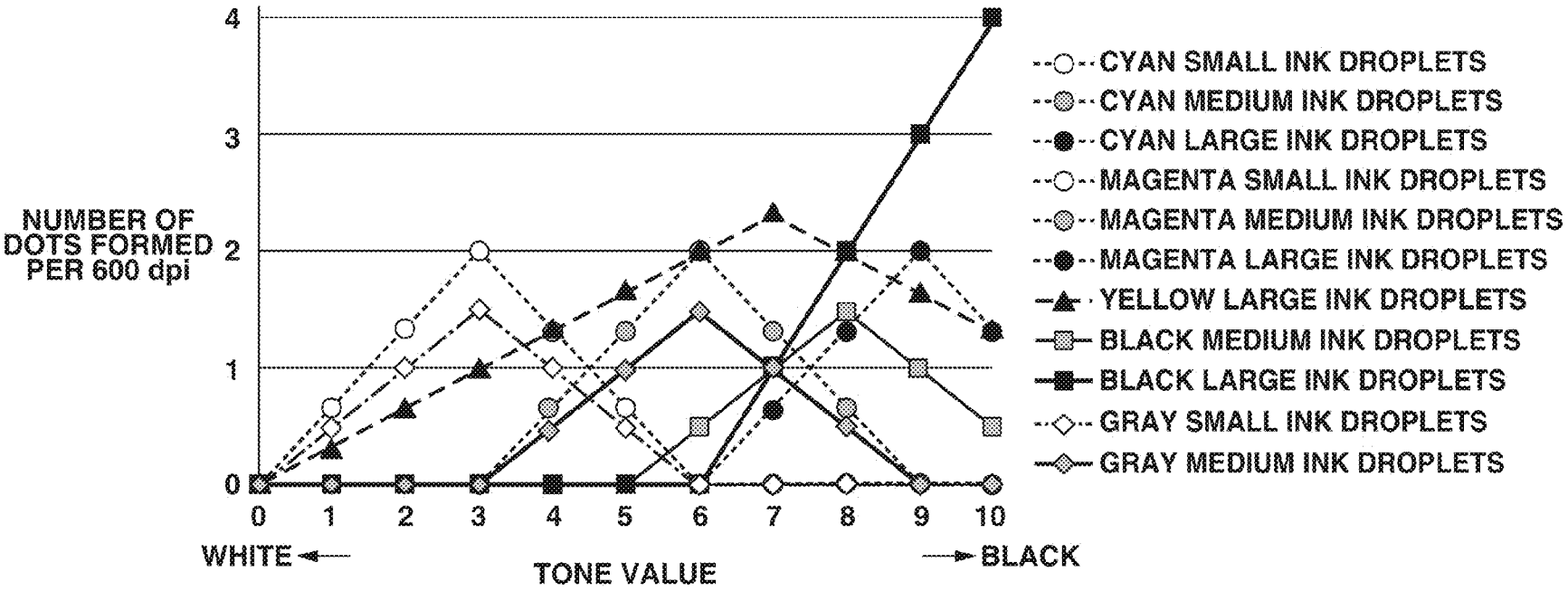
FIG. 12 is a chart illustrating a correlation between a tone value and the number of discharged ink droplets according to the exemplary embodiment.

FIG. 12 is a chart illustrating a correlation between the tone value of image data and the number of discharged ink droplets according to the present exemplary embodiment.

In FIG. 12, image data representing white, or (R, G, B)=(255, 255, 255), is defined to have a tone value=0. Image data representing black, or (R, G, B)=(0, 0, 0), is defined to have a tone value=10. Tones on the line from white to black through gray are equally divided into nine parts, which are defined to have tone values=1 to 9. In other words, all the tone values of 0 to 10 illustrated in FIG. 12 represent achromatic colors. The greater the tone value, the closer the represented color shifts from white to black. The vertical axis of FIG. 12 indicates the number of dots formed (the number of ink droplets discharged) per 600 dpi. In FIG. 12, ink droplets of each color ink discharged in approximately 5 pl from the discharge port arrays having a large discharge port diameter are represented as "large ink droplets". Ink droplets of approximately 2 pl discharged from the discharge port arrays having a medium discharge port diameter are represented as "medium ink droplets". Ink droplets of approximately 1 pl discharged from the discharge port arrays having a small discharge port diameter are represented as "small ink droplets".

A comparison between FIGS. 12 and 7 shows that, like the present exemplary embodiment, if gray ink is used, the numbers of ink droplets discharged of cyan, magenta, and yellow inks can be reduced at each tone as much as gray ink is added. Suppose that the amount of discharge of any one of cyan, magenta, and yellow inks varies due to manufacturing errors of the discharge ports. In such a case, if the numbers of ink droplets discharged of cyan, magenta, and yellow inks are relatively large, achromatic color reproduced may deviate from the gray hue. According to the present exemplary embodiment, the numbers of ink droplets discharged of cyan, magenta, and yellow inks can be made relatively small as much as gray ink is used. The foregoing deviation from the gray hue can thus be reduced.

As can be seen from FIG. 12, in the present exemplary embodiment, the number of gray small ink droplets discharged at each tone value is set to be smaller than those of cyan small ink droplets and magenta small ink droplets. Similarly, the number of gray medium ink droplets discharged at each tone value is set to be smaller than those of cyan medium ink droplets and magenta medium ink droplets. Such settings are made in view of an airflow associated with a discharge from the discharge port array unit LG3(H) of gray ink.

The discharge port array unit LG3(H) of gray ink does not include a discharge port array having a large discharge port diameter, and only one discharge port array unit LG3(H) of gray ink is provided on the Cl chip 20. Unlike cyan, magenta, and black inks with two discharge port array units, gray ink is therefore unable to be discharged from two discharge units in a distributed manner, and the amount of discharge of gray ink per discharge port array can be high. The discharge port array unit LG3(H) of gray ink can thus generate a relatively strong airflow, if not as strong as that of the discharge port array unit LG3(Y) of yellow ink which includes the discharge port arrays having a large discharge port diameter and is included singly in the Cl chip 20.

In view of this, in the present exemplary embodiment, the number of gray ink droplets discharged is set to be smaller than those of cyan and magenta ink droplets. This can suppress the occurrence of a strong airflow associated with the discharge of gray ink.

3. Order of Arrangement of Discharge Port Array Units in Chip

As illustrated in FIG. 10, the discharge port array units are arranged in the Cl chip 20 according to the present exemplary embodiment in the following order from the left: the discharge port array unit LG3(C1) of cyan ink, the discharge port array unit LG3(M1) of magenta ink, the discharge port array unit LG3(H) of gray ink, the discharge port array unit LG3(K1) of black ink, the discharge port array unit LG3(Y) of yellow ink, the discharge port array unit LG3(K2) of black ink, the discharge port array unit LG3(M2) of magenta ink, and the discharge port array unit LG3(C2) of cyan ink.

In the Cl chip 20 of the present exemplary embodiment, unlike the first exemplary embodiment, the discharge port array units of the respective colors are not perfectly line symmetrical. There is asymmetry ascribable to the discharge port array unit LG3(H) of gray ink. Specifically, the discharge port array units of gray, black, and yellow inks are arranged in the following order from the left: the discharge port array unit LG3(H) of gray ink, the discharge port array unit LG3(K1) of black ink, the discharge port array unit LG3(Y) of yellow ink, and the discharge port array unit LG3(K2) of black ink.

Forward scanning (scanning from left to right) applies gray, black, and yellow inks to a recording medium in order of black ink (LG3(K2)), yellow ink (LG3(Y)), black ink (LG3(K1)), and gray ink (LG3(H)). On the other hand, backward scanning (scanning from right to left) applies gray ink (LG3(H)), black ink (LG3(K1)), yellow ink (LG3(Y)), and black ink (LG3(K2)) in order. That is, during forward scanning, gray ink is applied after black and yellow inks. During backward scanning, gray ink is applied before black and yellow inks.

As described above, a color difference can occur between forward scanning and backward scanning if a plurality of color inks is applied to the same area of the recording medium in a superposed manner and the amounts of discharge of the plurality of color inks are large. More specifically, if the amounts of discharge of the plurality of color inks are small and the plurality of color inks is applied to the same area of the recording medium without much overlap, a color difference hardly occurs between forward scanning and backward scanning.

In the present exemplary embodiment, the discharge port array unit LG3(H) of gray ink does not include a discharge port array of large ink droplets. Besides, the numbers of gray small ink droplets and gray medium ink droplets discharged are set to be somewhat small. Specifically, both the numbers of gray small ink droplets and gray medium ink droplets discharged are set to not exceed two dots per 600 dpi.

The recording head 1 according to the present exemplary embodiment can thus be used without much noticeable color difference between forward scanning and backward scanning.

Like the first and second exemplary embodiments, the discharge port array unit LG3(Y) of yellow ink may generate a strong airflow associated with the discharge of the ink. The discharge port array units are arranged so that the discharge port array units LG3(C1) and LG3(C2) of cyan ink, the discharge port array units LG3(M1) and LG3(M2) of magenta ink, and the discharge port array unit LG3(H) of gray ink including discharge port arrays of small ink droplets are not adjacent to the discharge port array unit LG3(Y) of yellow ink, and the discharge port array units LG3(K1) and LG3(K2) of black ink including no discharge port array of small ink droplets are adjacent to the discharge port array unit LG3(Y) of yellow ink.

According to the foregoing configuration, the same effects as those of the first and second exemplary embodiments can be obtained even if a discharge port array unit of ink other than cyan, magenta, yellow, and black inks is included.

In the present exemplary embodiment, the discharge port array unit of gray ink is described to be included aside from the discharge port array units of cyan, magenta, yellow, and black inks in order to reduce color deviations in the gray hue, ascribable to variations in the amounts of discharge. However, other modes of embodiment may be employed. For example, suppose that a discharge port array unit of red ink is included to reduce color deviations in the red hue which can be reproduced by magenta and yellow. In such a case, the discharge port array unit of red ink may be configured similarly to the discharge port array unit of gray ink according to the present exemplary embodiment. The same applies when a discharge port array unit of green ink is included to reduce color deviations in the green hue which can be reproduced by yellow and cyan, and when a discharge port array unit of blue ink is included to reduce color deviations in the blue hue which can be reproduced by cyan and magenta.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

In the exemplary embodiments, a discharge port array unit including two discharge port arrays having a large discharge port diameter (for example, the discharge port array unit LG1(Y)) is described as a discharge port array unit that generates a strong airflow. A discharge port array unit including one discharge port array unit having a large discharge port diameter (for example, the discharge port array unit LG1(K1)) is described as a discharge port array arranged in a position adjacent to the discharge port array unit that generates a strong airflow. However, other modes of embodiment may be employed. If the number of discharge port arrays having a large discharge port diameter in a discharge port array unit generating a strong airflow is greater than the number of discharge port arrays having a large discharge port diameter in discharge port array units adjacent to the discharge port array unit generating the strong airflow, airflow-associated landing position deviations in discharge port array units including a discharge port array unit having a small discharge port diameter can be reduced.

In the foregoing exemplary embodiments, the reciprocal scanning of the recording head and the conveyance of a recording medium are described to be alternately performed to perform recording on the entire area of the recording medium. However, other modes of embodiment may be employed. For example, recording may be performed by scanning the recording head only in one direction. The configurations described in the exemplary embodiments may be applied to even a full-line recording apparatus which uses a long recording head extending across the entire area in the width direction of the recording medium and performs recording by discharging ink while conveying a recording medium with respect to the recording head.

In the foregoing exemplary embodiments, the discharge port arrays having a large discharge port diameter are described to include discharge ports of approximately 16 μm in diameter, the discharge port arrays having a medium discharge port diameter to include discharge ports of approximately 12 μm in diameter, and the discharge port arrays having a small discharge port diameter to include discharge ports of approximately 9 μm in diameter. Similar configurations to those of the exemplary embodiments may be employed if the sizes of discharge ports are roughly divided into three levels. For example, first discharge port arrays may include elliptical discharge ports having a major diameter of approximately 8 μm and a minor diameter of approximately 7 μm. Second discharge port arrays may include elliptical discharge ports having a major diameter of approximately 6 μm and a minor diameter of approximately 5 μm. Third discharge port arrays may include elliptical discharge ports having a major diameter of approximately 4 μm and a minor diameter of approximately 3 μm. Even in such a configuration, similar effects to those of the foregoing exemplary embodiments can be obtained by handling the first discharge port arrays as discharge port arrays having a large discharge port diameter, the second discharge port arrays as discharge port arrays having a medium discharge port diameter, and the third discharge port arrays as discharge port arrays having a small discharge port.

A recording head according to an exemplary embodiment of the present disclosure can make ink droplets discharged from a discharge port array having a small discharge port diameter less susceptible to an airflow associated with discharge of ink from another discharge port array.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-150412, filed Jul. 29, 2016, which is hereby incorporated by reference herein in its entirety.

What is claimed is:

1. A recording head comprising:

a plurality of discharge port array units each including at least one of a first discharge port array in which discharge ports having a first diameter as a discharge port diameter are arranged in a predetermined direction, a second discharge port array in which discharge ports having a second diameter smaller than the first diameter as a discharge port diameter are arranged in the predetermined direction, and a third discharge port array in which discharge ports having a third diameter smaller than the second diameter as a discharge port diameter are arranged in the predetermined direction, the plurality of discharge port array units including a first discharge port array unit configured to discharge ink of a first color, a second discharge port array unit configured to discharge ink of a second color, and a third discharge port array unit configured to discharge ink of a third color, the plurality of discharge port array units being juxtaposed in a crossing direction crossing the predetermined direction, wherein the first discharge port array unit includes N first discharge port arrays and does not include the second or third discharge port array, where N is equal to 2 or more, wherein the second discharge port array unit does not include N or more first discharge port arrays, includes the second discharge port array, and does not include the third discharge port array, wherein the third discharge port array unit includes the third discharge port array, and wherein the third discharge port array unit is not adjacent to the first discharge port array unit in the crossing direction, and the second discharge port array unit is adjacent to the first discharge port array unit in the crossing direction.

2. The recording head according to claim 1, wherein the first color is yellow, the second color is black, and the third color is either cyan or magenta.

3. The recording head according to claim 2, wherein the recording head includes only one first discharge port array unit among the plurality of discharge port array units.

4. The recording head according to claim 3, wherein the recording head includes only two third discharge port array units among the plurality of discharge port array units, and wherein the first discharge port array unit and the second discharge port array unit are arranged between the two third discharge port array units.

5. The recording head according to claim 4, wherein the recording head includes only two fourth discharge port array units configured to discharge ink of a fourth color among the plurality of discharge port array units, and wherein the first discharge port array unit, the second discharge port array unit, and the two third discharge port array units are arranged between the two fourth discharge port array units.

6. The recording head according to claim 5, wherein the fourth discharge port array units include the third discharge port array.

7. The recording head according to claim 6, wherein the fourth color is the other of cyan and magenta.

8. The recording head according to claim 7, wherein the recording head includes only two second discharge port array units among the plurality of discharge port array units, and wherein one of the two second discharge port array units is adjacent to one side of the first discharge port array unit, and wherein the other of the two second discharge port array units is adjacent to the other side of the first discharge port array unit.

9. The recording head according to claim 1, wherein the first discharge port array unit consists of two first discharge port arrays, wherein the second discharge port array unit consists of two discharge port arrays including one second discharge port array and one first discharge port array, and wherein the third discharge port array unit consists of two discharge port arrays including one third discharge port array and one second discharge port array.

10. The recording head according to claim 1, wherein the first discharge port array unit consists of two first discharge port arrays, wherein the second discharge port array unit consists of two discharge port arrays including one second discharge port array and one first discharge port array, and wherein the third discharge port array unit consists of three discharge port arrays including one third discharge port array, one second discharge port array, and one first discharge port array.

11. The recording head according to claim 1, wherein the plurality of discharge port array units includes a fifth discharge port array unit configured to discharge ink of a fifth color, and wherein each of one second discharge port array unit and one third discharge port array unit is adjacent to a different side among sides of the fifth discharge port array unit.

12. The recording head according to claim 11, wherein the fifth color is any one of gray, red, green, and blue.

13. The recording head according to claim 1, wherein each of the plurality of discharge port array units includes an ink chamber.

14. The recording head according to claim 1, wherein the plurality of discharge port array units is provided on a chip.

15. The recording head according to claim 1, wherein the plurality of discharge port array units is provided on a same nozzle plate.

16. The recording head according to claim 1, wherein discharge port arrays configured to discharge ink of a same color in each of the plurality of discharge port array units have no discharge port array configured to discharge ink of color other than the same color therebetween in the crossing direction.

17. The recording head according to claim 1, wherein when a tone lower than a predetermined tone among tones lying on a line from white to black through gray is reproduced, the second discharge port array unit performs no discharge and the first and third discharge port array units perform a discharge.

18. An inkjet recording apparatus comprising:

a recording head including a plurality of discharge port array units each including at least one of a first discharge port array in which discharge ports having a first diameter as a discharge port diameter are arranged in a predetermined direction, a second discharge port array in which discharge ports having a second diameter smaller than the first diameter as a discharge port diameter are arranged in the predetermined direction, and a third discharge port array in which discharge ports having a third diameter smaller than the second diameter as a discharge port diameter are arranged in the predetermined direction, the plurality of discharge port array units including a first discharge port array unit configured to discharge ink of a first color, a second discharge port array unit configured to discharge ink of a second color, and a third discharge port array unit configured to discharge ink of a third color, the plurality of discharge port array units being juxtaposed in a crossing direction crossing the predetermined direction; and a control unit configured to perform control of a recording operation in which the recording head discharges ink to record an image, wherein the first discharge port array unit includes N first discharge port arrays and does not include the second or third discharge port array, where N is equal to 2 or more, wherein the second discharge port array unit does not include N or more first discharge port arrays, includes the second discharge port array, and does not include the third discharge port array, wherein the third discharge port array unit includes the third discharge port array, and wherein the third discharge port array unit is not adjacent to the first discharge port array unit in the crossing direction, and the second discharge port array unit is adjacent to the first discharge port array unit in the crossing direction.

* * * * *